US008863522B2

(12) United States Patent
Cornell et al.

(10) Patent No.: US 8,863,522 B2
(45) Date of Patent: Oct. 21, 2014

(54) OPERATING STEAM TURBINE REHEAT SECTION WITH OVERLOAD VALVE

(71) Applicant: General Electric Company, Schenectady, NY (US)

(72) Inventors: Daniel Richard Cornell, Clifton Park, NY (US); Raymond Pang, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 157 days.

(21) Appl. No.: 13/652,597

(22) Filed: Oct. 16, 2012

(65) Prior Publication Data

US 2014/0102097 A1 Apr. 17, 2014

(51) Int. Cl.
*F01K 7/22* (2006.01)

(52) U.S. Cl.
USPC ..... 60/679; 60/663

(58) Field of Classification Search
CPC ..... F01K 7/02; F01K 7/025; F01K 7/04; F01K 7/22
USPC ..... 60/652, 660–663, 677, 679, 680, 684
See application file for complete search history.

(56) References Cited

U.S. PATENT DOCUMENTS

| | | | | |
|---|---|---|---|---|
| 2,884,760 | A * | 5/1959 | Buri | 60/658 |
| 4,164,848 | A * | 8/1979 | Gilli et al. | 60/652 |
| 4,403,476 | A | 9/1983 | Johnson et al. | |
| 4,404,476 | A | 9/1983 | Lezan | |
| 4,471,446 | A | 9/1984 | Podolsky et al. | |
| 4,576,008 | A | 3/1986 | Silvestri, Jr. | |
| 4,577,281 | A | 3/1986 | Bukowski et al. | |
| 4,589,256 | A * | 5/1986 | Akiba et al. | 60/660 |
| 5,379,588 | A * | 1/1995 | Tomlinson et al. | 60/39.182 |
| 5,435,138 | A | 7/1995 | Silvestri, Jr. | |
| 5,490,386 | A * | 2/1996 | Keller et al. | 60/660 |
| 6,062,017 | A * | 5/2000 | Liebig | 60/39.182 |
| 6,220,013 | B1 * | 4/2001 | Smith | 60/783 |
| 6,705,086 | B1 * | 3/2004 | Retzlaff et al. | 60/653 |
| 6,938,421 | B2 | 9/2005 | Foster-Pegg | |
| 8,015,811 | B2 | 9/2011 | Tyler et al. | |
| 8,707,700 | B2 * | 4/2014 | Sasanuma et al. | 60/653 |

(Continued)

FOREIGN PATENT DOCUMENTS

| | | | |
|---|---|---|---|
| DE | 10227709 | A1 * | 2/2003 |
| EP | 2584157 | A1 | 4/2013 |
| JP | 60060207 | A * | 4/1985 |
| JP | 2013204532 | A | 10/2013 |

OTHER PUBLICATIONS

GB Combined Search and Examination Report issued May 2, 2014 in connection with corresponding GB Patent Application No. GB1317965.0.

*Primary Examiner* — Thomas Denion
*Assistant Examiner* — Mickey France
(74) *Attorney, Agent, or Firm* — Ernest G. Cusick; Hoffman Warnick LLC

(57) ABSTRACT

Disclosed is an approach that uses an overload valve to operate a steam turbine reheat section. In one embodiment, the steam turbine reheat section receives a supply of reheated steam from a reheater at a first steam admission location via a reheat valve. The steam turbine reheat section is further adapted to receive a diverted portion of the reheated steam from the reheater at a second steam admission location via the overload valve.

20 Claims, 1 Drawing Sheet

(56) References Cited

U.S. PATENT DOCUMENTS

| | | | | |
|---|---|---|---|---|
| 2007/0204623 | A1* | 9/2007 | Rollins, III | 60/772 |
| 2010/0000216 | A1* | 1/2010 | Hofer et al. | 60/645 |
| 2010/0305768 | A1 | 12/2010 | Holt et al. | |
| 2011/0100008 | A1* | 5/2011 | Beul et al. | 60/645 |
| 2011/0140453 | A1* | 6/2011 | Shortlidge et al. | 290/1 A |
| 2012/0023945 | A1* | 2/2012 | Ishiguro et al. | 60/646 |
| 2012/0266598 | A1* | 10/2012 | Goto et al. | 60/679 |
| 2014/0102097 | A1* | 4/2014 | Cornell et al. | 60/645 |

* cited by examiner

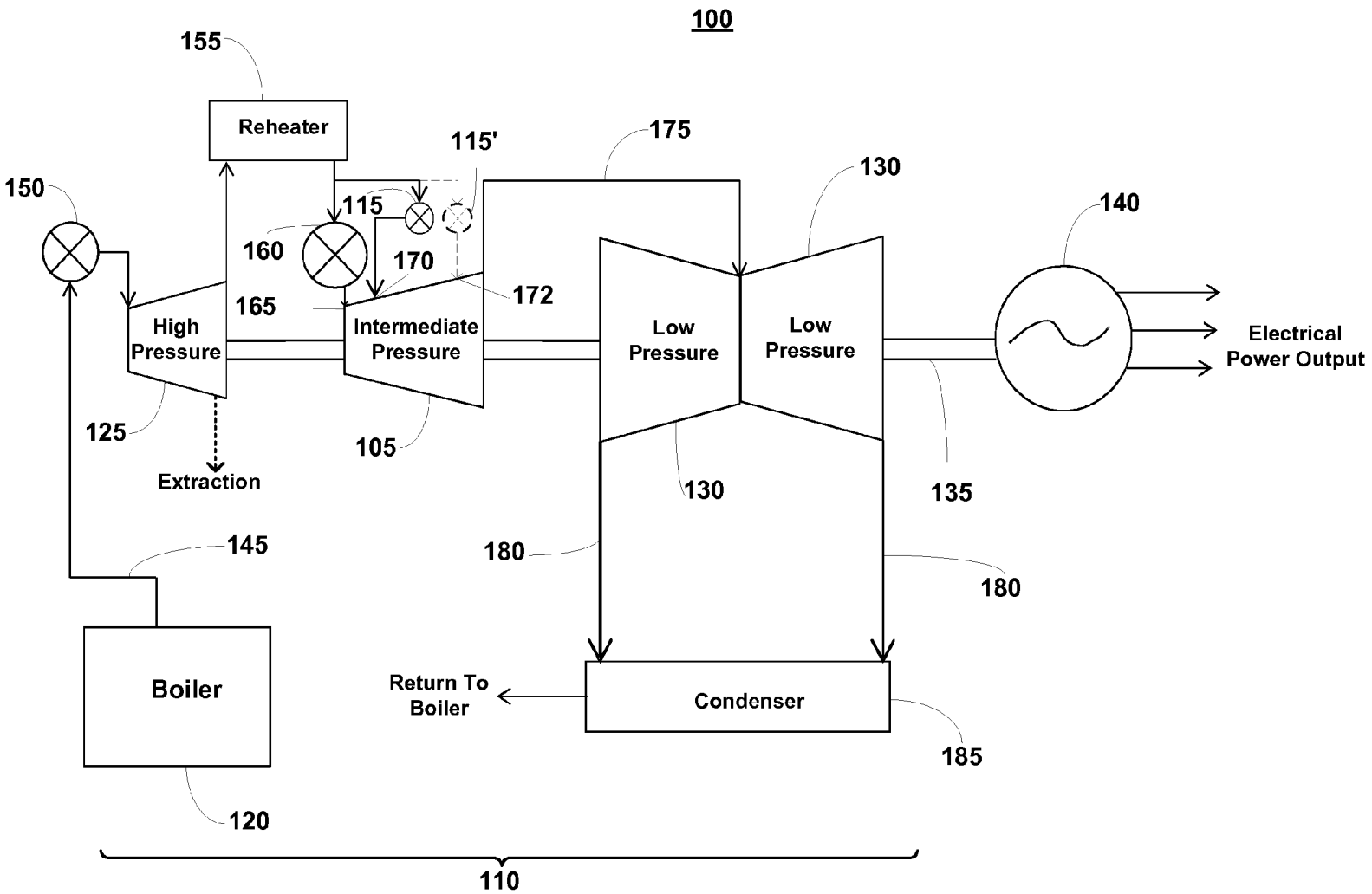
100
Electrical Power Output
140
135
180
185
130
Low Pressure
Low Pressure
130
Condenser
175
172
115'
170
115
Intermediate Pressure
105
180
Return To Boiler
110
Reheater
160
165
155
High Pressure
Extraction
145
Boiler
120
125
150

OPERATING STEAM TURBINE REHEAT SECTION WITH OVERLOAD VALVE

BACKGROUND OF THE INVENTION

The present invention relates generally to steam turbines, and more particularly, to operating a steam turbine reheat section of a steam turbine with an overload valve.

Steam turbines, especially those that are associated with combined-cycle power plants, can operate under various operating conditions. For example, heat recovery steam generator (HRSG) supplemental firing is often used with steam turbines in combined-cycle power plants to enable the plant to respond to fluctuations in load demand. Typically, this can be helpful in improving peak power production or enabling higher steam production to compensate for the lack of production from another unit within the plant. Generally, supplemental firing results in more steam being supplied to the steam turbine. Typically, this increase in steam flow, as a result of supplemental firing, results in an increase of steam flow to the high pressure turbine section, which will cause an increase of flow of steam supplied to the remaining lower pressure turbine sections. This increase in steam flow results in increased pressures at the steam admission inlets of these lower pressure turbine sections. An increase in pressure at the steam admission inlets of these lower pressure turbine sections has implications on the components used in these sections. For example, the components of these lower pressure turbine sections typically have to be designed to withstand substantial increases in pressures that can arise due to supplemental firing. Designing these lower pressure turbine sections to withstand substantial increases in pressures that can arise during supplemental firing can be costly and add complexity to the overall operation of the power plant.

BRIEF DESCRIPTION OF THE INVENTION

In one aspect of the present invention, a steam turbine is provided. In this aspect of the present invention, the steam turbine comprises a high pressure turbine section and at least one lower pressure turbine section coupled to the high pressure turbine section. A main steam valve regulates flow of steam from a steam generating source to the high pressure turbine section. A reheater reheats steam exhausted from the high pressure turbine section. A reheat valve regulates reheated steam from the reheater to the at least one lower pressure turbine section at a first steam admission location. An overload valve supplies a diverted portion of the reheated steam from the reheater to the at least one pressure turbine section at a second steam admission location.

In another aspect of the present invention, a steam turbine is provided. In this aspect of the present invention, the steam turbine comprises a high pressure turbine section, a low pressure turbine section, and an intermediate pressure turbine section located between the high pressure turbine section and the low pressure turbine section. A steam generating source generates steam for use by the high pressure turbine section, the intermediate pressure turbine section and the low pressure turbine section. A main steam valve regulates flow of the steam generated from the steam generating source to the high pressure turbine section. A reheater reheats steam exhausted from the high pressure turbine section. A reheat valve regulates reheated steam from the reheater to an inlet of the intermediate pressure turbine section. An overload valve supplies a diverted portion of the reheated steam from the reheater to the intermediate pressure turbine section at a location that is downstream of the inlet that receives the reheated steam supplied by the reheat valve.

In a third aspect of the present invention, there is a method of operating a steam turbine. In this aspect of the present invention, the method comprises: supplying steam to a high pressure turbine section; reheating steam exhausted from the high pressure turbine section; supplying the reheated steam to an inlet of a lower pressure turbine section; diverting a portion of the reheated steam supplied to the inlet of the lower pressure turbine section in response to detection of a change in operating condition at the high pressure turbine section; and supplying the diverted portion of the reheated steam to the lower pressure turbine section at a location that is downstream of the inlet receiving the reheated steam.

BRIEF DESCRIPTION OF THE DRAWINGS

FIG. 1 is a schematic diagram of an electrical power generation plant illustrating a steam turbine reheat section of a steam turbine operating with an overload valve according to one embodiment of the present invention.

DETAILED DESCRIPTION OF THE INVENTION

Various embodiments of the present invention are directed to operating a reheat section of a steam turbine with inlet variable pressure flow capability to provide added capacity for the overall steam turbine during different operating conditions. In one embodiment, an overload valve is used to supply a diverted portion of reheated steam generated from a reheater (e.g., a reheater section of a steam generating source) to the steam turbine reheat section which may be an intermediate pressure turbine section. The overload valve operates in conjunction with a reheat valve that regulates the reheated steam from the reheater to an inlet of the steam turbine reheat section. In one embodiment, the diverted portion of the reheated steam from the reheater is supplied by the overload valve to the steam turbine reheat section at a steam admission location along the steam path that is downstream of the inlet that receives the reheated steam from the reheat valve.

In operation, the overload valve can throttle the supply of the diverted portion of the reheated steam to the steam turbine reheat section to accommodate changes in conditions (e.g., change in steam flow, temperature and pressure) occurring upstream in the steam turbine such as at a high pressure turbine section and the reheater. As used herein, "to throttle" or "throttling" means varying the pressure-flow passing characteristics of the overload valve by varying the effective area of valve. The operation of the overload valve can also provide the steam turbine reheat section with variable swallowing capacity under different operating conditions. Furthermore, the operation of the overload valve in conjunction with the reheat valve can provide variable pressure and flow capability at the inlet of the steam turbine reheat section. In addition, the operation of the reheat valve in conjunction with the operation of the overload valve can alleviate axial thrust in the various sections of the steam turbine (e.g., the high pressure turbine section, the intermediate pressure turbine section and the low turbine section).

FIG. 1 is a schematic diagram of an electrical power generation plant 100 in which various embodiments of the present invention may operate. In particular, FIG. 1 shows a steam turbine reheat section 105 of a steam turbine 110 used in electrical power generation plant 100 operating with an overload valve 115 according to one embodiment of the present invention. Steam turbine reheat section 105 is illustrated in FIG. 1 as an intermediate pressure (IP) turbine section, which generally is the section of a steam turbine that is used to receive steam that has been reheated upon being exhausted from a high pressure (HP) turbine section of the steam turbine. The description that follows treats the IP turbine section 105 illustrated in FIG. 1 as the steam turbine reheat section that operates in steam turbine 110 in conjunction with overload valve 115. However, those skilled in the art will appreciate that the steam turbine reheat section can be any lower pressure turbine section in the steam turbine that receives HP steam that has been reheated.

Furthermore, those skilled in the art will appreciate that steam turbine 110 as illustrated in electrical power generation plant 100 is only one example of a steam turbine configuration in which the various embodiments of the present embodiment can operate and is not intended to be limiting. In addition, those skilled in the art will appreciate that electrical power generation plant 100 is only one example of a power generation plant in which the use of an overload valve can be used with a steam turbine reheat section to provide benefits such as variable inlet pressure flow capability, and is not intended to be limiting. For example, one such electrical power generation plant that the various embodiments of the present invention has applicability is with a combined-cycle power plant that uses a heat recovery steam generator (HRSG) to heat up exhaust products generated from a gas turbine to produce steam to be utilized by the steam turbine.

Referring to FIG. 1, a boiler 120, acting as a steam generating source, supplies the motive fluid (i.e., steam) to drive the turbine sections of steam turbine 110. Although the steam generating source in the description that follows is a boiler, those skilled in the art will appreciate that other steam generating sources could be used. For example, in a combined-cycle power plant embodiment, an HRSG could be used as the steam generating source that supplies the steam to drive the turbine sections of steam turbine 110. As shown in FIG. 1, the turbine sections of steam turbine 110 includes a HP turbine section 125, a low pressure (LP) turbine section 130 and IP turbine section 105, which is located between HP turbine section 125 and LP turbine section 130. A common shaft 135 couples HP turbine section 125, LP turbine section 130 and IP turbine section 105 to drive an electrical generator 140 that is also coupled to the shaft. The use of common shaft 135 is only illustrative of one embodiment in which the various embodiments of the present invention have applicability. Those skilled in the art will appreciate that the various embodiments of the present invention have applicability with other shaft arrangements (e.g., multiple shaft lines). The electrical power output from electrical generator 140 can supply power to a load such as an electrical grid network (not illustrated). Although HP turbine section 125, LP turbine section 130 and IP turbine section 105 are illustrated in FIG. 1 as being coupled to each other and to electrical generator 140 by shaft 135, those skilled in the art will appreciate that other coupling and shaft line arrangements may be used.

As shown in FIG. 1, the steam flow path from boiler 120 is through steam conduit 145 from which steam may be taken to HP turbine section 125. A main steam valve 150 regulates the flow of the steam generated from boiler 120 that is carried along steam conduit 145 to HP turbine section 125. Although main steam valve 150 is illustrated in FIG. 1 as a single valve it can include various valve arrangements used to discharge steam to HP turbine section 125. For example, in one embodiment, these main steam valves can discharge steam to HP turbine section 125 either through circumferentially arranged nozzle arcs in a partial admission configuration or in a single admission, full arc inlet configuration. Both of these configurations and their operation are well known to those skilled in the art.

Steam exhausted from HP turbine section 125 passes through a reheater 155 that reheats the exhausted steam to an increased temperature. Although reheater 155 is illustrated in FIG. 1 as a separate and distinct unit, it may be a section of boiler 120 or an HRSG in a combined-cycle power plant embodiment. Steam from reheater 155 is passed to IP turbine section 105. As shown in FIG. 1, a reheat valve 160 regulates the reheated steam from reheater 155 to a first steam admission location 165 of IP turbine section 105. In one embodiment, first steam admission location 165 is an inlet of IP turbine section 105. Overload valve 115, acting as a bypass to reheat valve 160 supplies a diverted portion of the reheated steam from reheater 155 to IP turbine section 105 at a second steam admission location 170. In one embodiment, overload valve 115 supplies a diverted portion of the reheated steam from reheater 155 to IP turbine section 105 at a location that is downstream of the inlet that receives the reheated steam supplied by reheat valve 160.

The locations that overload valve 115 and reheat valve 160 deliver the reheated steam to IP turbine section 105 as illustrated in FIG. 1 is only an example of one possible configuration and those skilled in the art will appreciate that other steam admission locations along the IP turbine section can be utilized. Although one embodiment includes using one overload valve 115 and one reheat valve 160, more than one of each in differing combinations may be used to supply the reheated steam to IP turbine section 105. For example, FIG. 1 shows in phantom another overload valve 115' operating in conjunction with overload valve 115 to bypass reheat valve 160 and supply a diverted portion of the reheated steam to IP turbine section 105 at a steam admission location 172. In another embodiment, more than one overload valve 115 can be used to bypass more than one reheat valve 160 and supply a diverted portion of the reheated steam to IP turbine section 105. In still another embodiment, a plurality of overload valves 115 in a series configuration can be used to divert a portion of the reheated steam to IP turbine section 105 to different steam admission locations.

As shown in FIG. 1, steam exhausted from IP turbine section 105 is supplied to LP turbine section 130 via a crossover steam conduit 175. In one embodiment, LP turbine section 130 may include two LP turbine sections each having a steam conduit 180 that supplies steam exhausted from LP turbine sections 130 to a condenser 185. Those skilled in the art will appreciate that the LP turbine section can be configured in other implementations and is not meant to limit the scope of the various embodiments of the present invention described herein. For example, the LP turbine section could include a single flow LP section, one double flow LP section, or two double flow LP sections. Condenser 185 can condense the steam exhausted from LP turbine sections 130 and recycle the condensate back to boiler 120.

Those skilled in the art will recognize that steam turbine 110 of electrical power generation plant 100 may have other components than that shown in FIG. 1. For example, steam turbine 110 could have a controller that controls the operation of the turbine (e.g., speed and load). In addition to controlling the speed and load of steam turbine 110, the controller could regulate the supply of the steam from boiler 120 through HP turbine section 125, IP turbine section 105, and LP turbine section 130 via main steam valve 150, reheat valve 160 and overload valve 115. For example, the controller could include a feedback control system which positions (i.e., determines the degree of opening of) main steam valve 150, reheat valve 160 and overload valve 115 to admit more or less steam to their respective turbine sections.

The use of overload valve 115 to bypass reheat valve 160 and supply reheated steam from reheater 155 in the configuration illustrated in FIG. 1 can be used to provide IP turbine section 105 with variable pressure flow capability at its inlet. This results in steam turbine 110 having added capability to operate in a multitude of operating conditions. For example, if within a combined-cycle plant arrangement, the HRSG undergoes supplemental firing, then more steam will be supplied to the steam turbine. The increase in flow of the steam at the HP turbine section will cause an increase of flow of steam supplied to the lower pressure turbine sections. In particular, the IP turbine section will have an increase in steam flow at its inlet which corresponds to an increase in pressure at this steam admission location.

Overload valve 115 and reheat valve 160 can be adjusted accordingly to withstand the substantial increases in pressures that can arise in IP turbine section 105 due to supplemental firing. In particular, the steam valves (i.e., the main valve 150 or the reheat valve 160) can change position for a particular flow and therefore throttle which will increase or decrease the pressure ahead of the valves. Using the reheat valve 160 and the overload valve 115 together will redistribute the amount of reheat flow from the boiler 120 to each steam admission location within the IP section 105. In this scenario, the controller of steam turbine 110 could detect an increase in flow of steam supplied to HP turbine section 125, and consequently open overload valve 115 to start diverting a portion of the reheated steam supplied to the inlet of IP turbine section 105. The controller would also control the reheat valve's supply of the reheated steam to the inlet of IP turbine section 105 to operate in conjunction with overload valve 115. In particular, the controller could throttle overload valve 115 and reheat valve 160 to supply an appropriate amount of flow that will facilitate swallowing the increased flow and pressure at IP turbine section 105 that arises because of changes in conditions occurring upstream at HP turbine section 125 and reheater 155. This swallowing capability can occur without resulting in an increase in pressure at IP turbine section 105. Thus, the throttling of overload valve 115 in conjunction with reheat valve 160 enables IP turbine section 105 to have variable swallowing capacity under different operating conditions.

To operate steam turbine 110 in this manner, boiler 120 provides a supply of steam to HP turbine section 125. Steam exhausted from HP turbine section 125 is reheated by reheater 155 (e.g., a reheat section of the boiler, an HRSG). Reheat valve 160 supplies the reheated steam to an inlet of IP turbine section 105. Overload valve 115 diverts a portion of the reheated steam supplied to the inlet of IP turbine section 105 in response to detection of an increase in flow of steam supplied to HP turbine section 125. In another embodiment, overload valve 115 can divert a portion of the reheated steam supplied to the inlet of IP turbine section 105 in response to detection of pressure or flow directly upstream of reheat valve 160. In another embodiment, overload valve 115 can divert a portion of the reheated steam supplied to the inlet of IP turbine section 105 in response to detection of higher temperatures at the exhaust of HP turbine section 125. For example, consider a steam turbine operating at low loads in a combined-cycle plant arrangement. Low loads and corresponding reduced steam production from the HRSG can impose increased duty on the HP section exhaust, mainly in the form of higher temperatures. These higher temperatures will either result in a limitation of plant operation or require changes to the HP section design and plant piping to accommodate higher temperatures. In this scenario, a portion of the reheated steam supplied to the inlet of the LP turbine section can be diverted in response to detection of a change in plant operating condition, especially at lower loads.

In one embodiment, the diverted portion of the reheated steam is supplied to IP turbine section 105 at a location that is downstream of the inlet receiving the reheated steam from reheat valve 160. The flow of the diverted portion of the reheated steam supplied to IP turbine section 105 can be adjusted to an amount that is maintained within a predetermined pressure range of operation. If the supplemental firing is increased and causes an increase in flow of steam supplied to HP turbine section 125, then the flow of the diverted portion of the reheated steam supplied to IP turbine section 105 can be adjusted to an amount that is maintained within the predetermined pressure range of operation. Subsequently, the diverting of a portion of the reheated steam supplied to the inlet of IP turbine section 105 can be diverted in response to detecting an end of the supplemental firing.

In addition to providing variable swallowing capability, the operation of overload valve 115 in conjunction with reheat valve 160 can be used to alleviate axial thrust in the various sections of steam turbine 110. For example, in some scenarios it may be desirable to extract high pressure steam from steam turbine 110 and use it for cogeneration purposes. As shown in FIG. 1, high pressure steam generated from HP turbine section 125 can be extracted from the exhaust part of this turbine section. Those skilled in the art will appreciate that the extraction of steam can be drawn from different parts of steam turbine 110. In some instances, when a large quantity of steam is extracted from HP turbine section 125, a drop in pressure can occur at the extraction location. A drop in pressure at HP turbine section 125 can have ramifications in terms of the axial thrust at this section and other downstream sections such as IP turbine section 105 and LP turbine section 130.

To alleviate the axial thrust that can occur by extracting steam from HP turbine section 125, the controller of steam turbine 110 can open overload valve 115 to begin diverting a portion of the reheated steam supplied to the inlet of IP turbine section 105 in response to detection of the pressure drop that arises due to extraction. In particular, the operation of the overload valve 115 and reheat valve 160 can be opened and closed in an appropriate manner to maintain the desired thrust direction and magnitude in steam turbine 110 as steam is extracted from HP turbine section 125. In this manner, the flow of the diverted portion of the reheated steam from overload valve 115 and the flow of the reheated steam from reheat valve 160 can be adjusted to an amount that is maintained within a predetermined pressure range of operation. After the steam extraction is discontinued, the diverting of a portion of the reheated steam supplied to IP turbine section 105 can be discontinued.

Technical effects of the various embodiments of the present invention include enabling the steam turbine reheat section with the capability of maximizing performance and output across a large range of steam conditions. This can include increased levels of supplemental firing and also large extractions of steam for gas turbine power augmentation. Meeting large variations in steam conditions while achieving optimum performance will provide considerable operational flexibility across a large power generation application space.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A steam turbine, comprising:

a high pressure turbine section;

at least one lower pressure turbine section coupled to the high pressure turbine section;

a steam generating source;

a main steam valve regulating flow of steam from the steam generating source to the high pressure turbine section;

a reheater reheating steam exhausted from the high pressure turbine section;

a reheat valve that admits reheated steam from the reheater to the at least one lower pressure turbine section at a first steam admission location, wherein the reheat valve regulates flow of the reheated steam from the reheater to the at least one lower pressure turbine section at the first steam admission location; and at least one overload valve supplying a diverted portion of the reheated steam from the reheater to the at least one lower pressure turbine section at a second steam admission location.

2. The steam turbine according to claim 1, wherein the first steam admission location is at an inlet of the at least one lower pressure turbine section.

3. The steam turbine according to claim 2, wherein the second steam admission location is in a steam path of the at least one lower pressure turbine section downstream from the inlet.

4. The steam turbine according to claim 1, wherein the overload valve is configured to regulate the supply of the diverted portion of the reheated steam to the at least one lower pressure turbine section to accommodate changes in conditions occurring within the high pressure turbine section and the reheater.

5. The steam turbine according to claim 1, wherein operation of the overload valve enables the at least one lower pressure turbine section to have variable swallowing capacity under different operating conditions.

6. The steam turbine according to claim 1, wherein the at least one overload valve comprises more than one overload valve.

7. The steam turbine according to claim 6, wherein each of the more than one overload valve is configured to divert portions of the reheated steam to a plurality of steam admission locations.

8. A steam turbine, comprising:

a high pressure turbine section;

a low pressure turbine section;

an intermediate pressure turbine section located between the high pressure turbine section and the low pressure turbine section;

a steam generating source that generates steam for use by the high pressure turbine section, the intermediate pressure turbine section and the low pressure turbine section;

a main steam valve that regulates the flow of the steam generated from the steam generating source to the high pressure turbine section;

a reheater that reheats steam exhausted from the high pressure turbine section;

a reheat valve that regulates reheated steam from the reheater to an inlet of the intermediate pressure turbine section; and an overload valve that supplies a diverted portion of the reheated steam from the reheater to the intermediate pressure turbine section at a location that is downstream of the inlet that receives the reheated steam supplied by the reheat valve.

9. The steam turbine according to claim 8, wherein the overload valve is configured to throttle the supply of the diverted portion of the reheated steam to the intermediate pressure turbine section to accommodate changes in conditions occurring upstream within the high pressure turbine section and the reheater that relate to changes in steam flow, pressure and temperature.

10. The steam turbine according to claim 8, wherein operation of the overload valve enables the intermediate pressure turbine section to have variable swallowing capacity under different operating conditions.

11. The steam turbine according to claim 8, wherein operation of the reheat valve in conjunction with operation of the overload valve provides variable pressure and flow capability at the inlet of the intermediate pressure turbine section.

12. The steam turbine according to claim 8, wherein operation of the reheat valve in conjunction with operation of the overload valve provides variable pressure and alleviates axial thrust in one of the high pressure turbine section, the intermediate pressure turbine section and the low turbine section.

13. A method of operating a steam turbine, comprising:

supplying steam to a high pressure turbine section;

reheating steam exhausted from the high pressure turbine section with a reheater;

supplying the reheated steam to an inlet of a lower pressure turbine section with a reheat valve that admits reheated steam from the reheater to the inlet of the lower pressure turbine section;

diverting a portion of the reheated steam supplied to the inlet of the lower pressure turbine section by the reheat valve with an overload valve in response to detection of a change in operating condition at the high pressure turbine section; and supplying the diverted portion of the reheated steam from the overload valve to the lower pressure turbine section at a location that is downstream of the inlet receiving the reheated steam from the reheat valve.

14. The method according to claim 13, further comprising adjusting a flow of the diverted portion of the reheated steam supplied to the lower pressure turbine section to an amount that is maintained within a predetermined pressure range of operation.

15. The method according to claim 13, wherein the change in operating condition that initiates a diversion of the portion of the reheated steam includes a detection of one of an increase in flow of steam supplied to the high pressure turbine section and an increase in flow or pressure directly upstream of a location at which a portion of the reheated steam is diverted.

16. The method according to claim 15, wherein the detection of an increase in flow of steam supplied to the high pressure turbine section is due to an introduction of supplemental firing.

17. The method according to claim 16, further comprising adjusting a flow of the diverted portion of the reheated steam supplied to the lower pressure turbine section to an amount that is maintained within a predetermined pressure range of operation as the supplemental firing is increased.

18. The method according to claim 17, further comprising discontinuing the diverting of a portion of the reheated steam supplied to the inlet of the lower pressure turbine section in response to detecting an end of the supplemental firing.

19. The method according to claim 13, further comprising throttling the supply of the reheated steam to the inlet of the lower pressure turbine section and throttling the supply of the diverted portion of the reheated steam to the downstream location of the lower pressure turbine section to adjust exhaust pressure of the high pressure turbine section to an amount that is maintained within predetermined pressure limits.

20. The method according to claim 13, wherein the change in operating condition that initiates a diversion of the portion of the reheated steam includes detection of a pressure drop that arises from steam being extracted from the high pressure turbine section.

* * * * *